US008141469B1

(12) United States Patent
Holmes et al.

(10) Patent No.: US 8,141,469 B1
(45) Date of Patent: Mar. 27, 2012

(54) QUICK-RELEASE SPINDLE FOR GUN TUBE

(75) Inventors: Edward W. Holmes, Valley Falls, NY (US); Wayland P. Barber, Mechanicville, NY (US); Leslie C. Blahut, Westfield, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/894,675

(22) Filed: Sep. 30, 2010

(51) Int. Cl.
*F41A 3/00* (2006.01)

(52) U.S. Cl. ..... 89/17

(58) Field of Classification Search ..... 89/17–26, 89/27.11–28.2, 1.1
See application file for complete search history.

(56) References Cited

U.S. PATENT DOCUMENTS 1,559,106 A * 10/1925 Julstedt ..... 89/20.2
2,457,266 A * 12/1948 Oliver ..... 89/27.13
2,466,174 A * 4/1949 Knowlton ..... 89/27.13
2,482,865 A * 9/1949 Oliver ..... 89/27.13
2,484,053 A * 10/1949 Rosenkrantz ..... 89/21
4,404,888 A * 9/1983 Gentiluomo ..... 89/26
5,115,716 A * 5/1992 Doering et al. ..... 89/25
6,223,643 B1 * 5/2001 Muller ..... 89/26
6,840,150 B1 * 1/2005 Davis ..... 89/1.1
6,955,111 B1 * 10/2005 Davis ..... 89/1.1
2007/0199434 A1 * 8/2007 Crotty et al. ..... 89/45

* cited by examiner

*Primary Examiner* — Troy Chambers
(74) *Attorney, Agent, or Firm* — John F. Moran

(57) ABSTRACT

The breech end of a gun may include a quick-release spindle assembly. A carrier may have a locking collar rotatably disposed therein. The locking collar may have a through-bore and one or more projections extending into the through-bore. The locking collar may be rotatable between spindle lock and spindle release positions. A spindle may be translatably disposed in the through-bore of the locking collar. The spindle may include one or more projections extending radially outward from a rear outer surface of the spindle. In the spindle lock position of the locking collar, the projections of the spindle may be aligned with the projections of the locking collar to thereby prevent translation of the spindle in a forward direction. In the spindle release position of the locking collar, the projections of the spindle may not be aligned with the projections of the locking collar to thereby allow translation of the spindle in a forward direction.

12 Claims, 8 Drawing Sheets

QUICK-RELEASE SPINDLE FOR GUN TUBE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to guns that may fire caseless ammunition.

A gun such as, for example, a cannon, may fire either cased or caseless ammunition. A gun having a firing chamber for caseless ammunition may include an obturation assembly. The obturation assembly may seal the rear end of the firing chamber when a propellant charge is combusted to launch a projectile. On the other hand, for guns that fire cased ammunition, the sealing may be performed by the case of the ammunition itself, held in position by a breech block.

A conventional obturation assembly is described in U.S. Pat. No. 2,482,865, issued on Sep. 27, 1949 to Oliver. A conventional obturation assembly may include a spindle having a shaft and a mushroom shaped head, and an obturation set. The obturation set may include a resilient obturator pad for mating with and sealing against an obturation seat, an inner ring and two retaining (split) rings. The obturation seat may be defined by the rim of the mouth at the rear end of the firing chamber.

When the spindle is displaced axially relative to the barrel of the gun by the combustion of the propellant charge in the firing chamber, the obturator pad may deform radially outward into sealing engagement with the obturation seat. The retaining rings may limit the deformation of the obturator pad and may prevent extrusion of the obturator pad. The obturation assembly may be held in position by the breech block of the gun. The shaft of the spindle may extend through a hole in a carrier abutting the breech block.

A known method of removing the spindle from the gun may be time-consuming, may involve the removal of many other associated parts, and may require the use of specialized tools. Moreover, the method may be repetitive because the obturator pad and split rings may need to be removed every day for cleaning and for wear and damage inspection. Spindle removal may be accomplished by unscrewing a nut-type of component from the threaded breech end of a spindle.

Some spindle-retaining technology may be complex and may involve the use of many components. The spindle may be keyed to prevent it from turning and the spindle nut may have a flip key to keep it from unscrewing. Behind the face of the spindle may be an obturator pad assembly and then a breech block. The breech block may be held to the carrier by a nut-like component. Often, there may be other devices on the back of the carrier which may have to be removed to access the nut that holds the spindle. These other devices may also require reinstallation after the spindle is reinstalled. Consequently, removal of the traditional spindle may take several minutes.

There is a need for a quick-release spindle that may be rapidly removed and installed, with minimal involvement of other components.

SUMMARY OF THE INVENTION

It is an object of the invention to provide a quick-release spindle that may be rapidly removed and installed, with minimal involvement of other components.

One aspect of the invention is an apparatus for a breech end of a gun that fires caseless ammunition. The apparatus may include a carrier having a locking collar rotatably disposed therein. The locking collar may have a through-bore and at least one projection extending into the through-bore. The locking collar may be rotatable between spindle lock and spindle release positions.

A spindle may be translatably disposed in the through-bore of the locking collar. The spindle may include an enlarged portion at a forward end thereof for engaging an obturator pad assembly. The spindle may have a central bore and at least one projection extending radially outward from a rear outer surface of the spindle.

In the spindle lock position of the locking collar, the at least one projection of the spindle may be aligned with the at least one projection of the locking collar to thereby prevent translation of the spindle in a forward direction. In the spindle release position of the locking collar, the at least one projection of the spindle may not be aligned with the at least one projection of the locking collar to thereby allow translation of the spindle in the forward direction.

A handle may be fixed to the locking collar for rotating the locking collar between the spindle lock and the spindle release positions. The handle may extend through the carrier.

The carrier may include a spindle lock hole, a spindle release hole, and a slot formed between the spindle lock hole and the spindle release hole. The handle may be rotatable between the spindle lock hole and the spindle release hole by way of the slot. The handle may include a spring-loaded sleeve for locking the handle in one of the spindle lock hole and the spindle release hole.

The handle may have a central member fixed to the locking collar. The spring-loaded sleeve may be disposed around the central member. The spring-loaded sleeve may include a spring with one end that bears against one end of the spring-loaded sleeve and another end that bears against a top of the central member.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
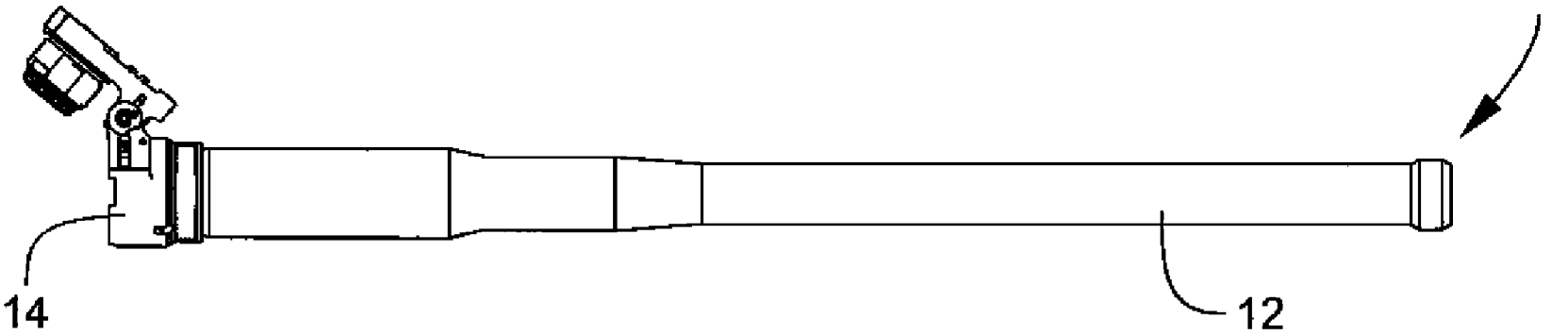
FIG. 1 is a schematic drawing of a gun for firing caseless ammunition.

FIG. 1 is a schematic drawing of a gun 10 that may fire caseless ammunition. Gun 10 may include a gun tube 12 and a breech assembly 14.

Figure 2:
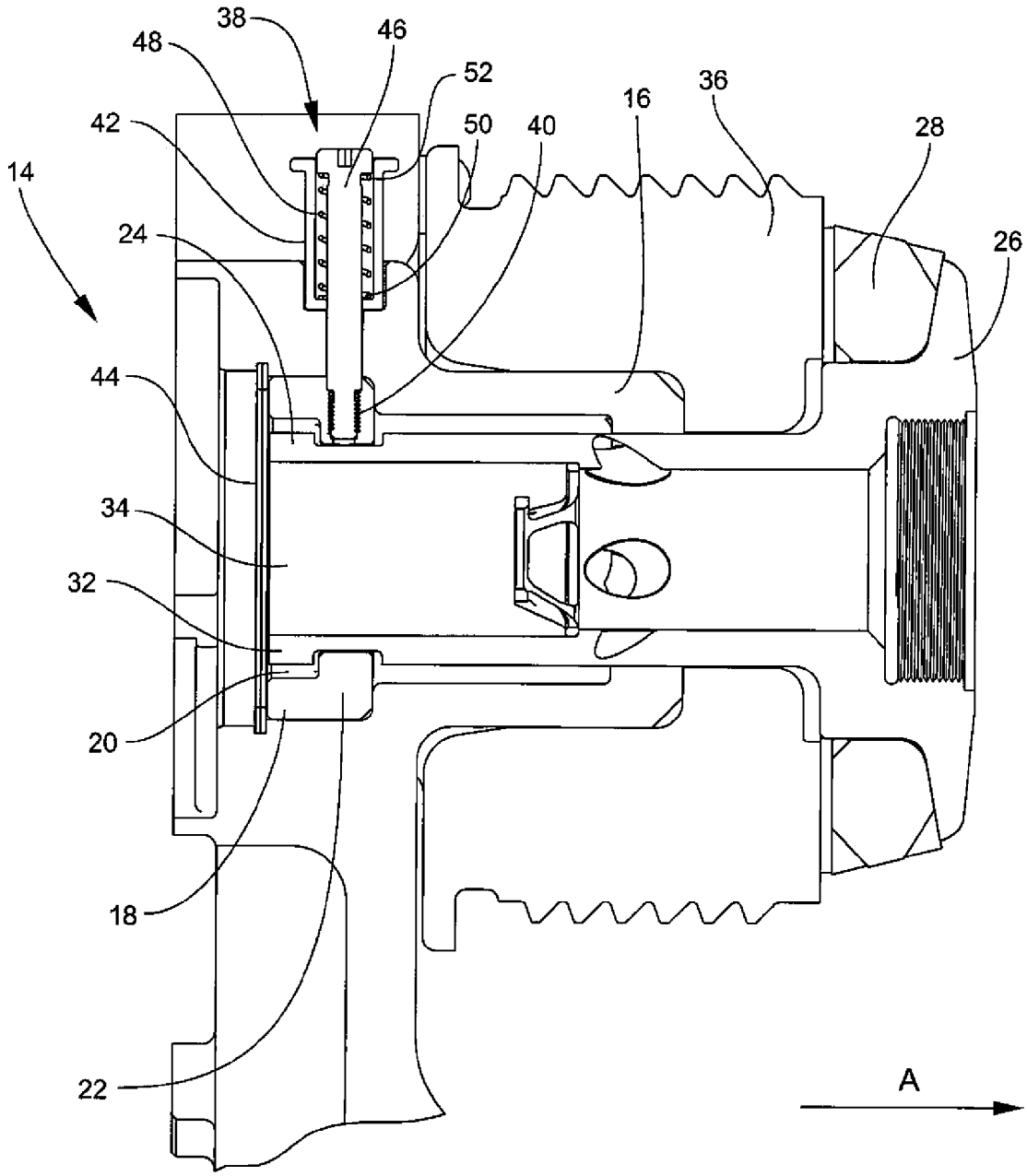
FIG. 2 is a cutaway side view of a quick-release spindle assembly.

FIG. 2 is a cutaway side view of a quick-release spindle assembly located in the breech assembly 14. Breech assembly 14 may include a carrier 16 and a breech block 36. Carrier 16 may have a locking collar 18 rotatably disposed therein. A retaining ring 44 may be disposed in carrier 16 to hold locking collar 18 in carrier 16.

Figure 3:
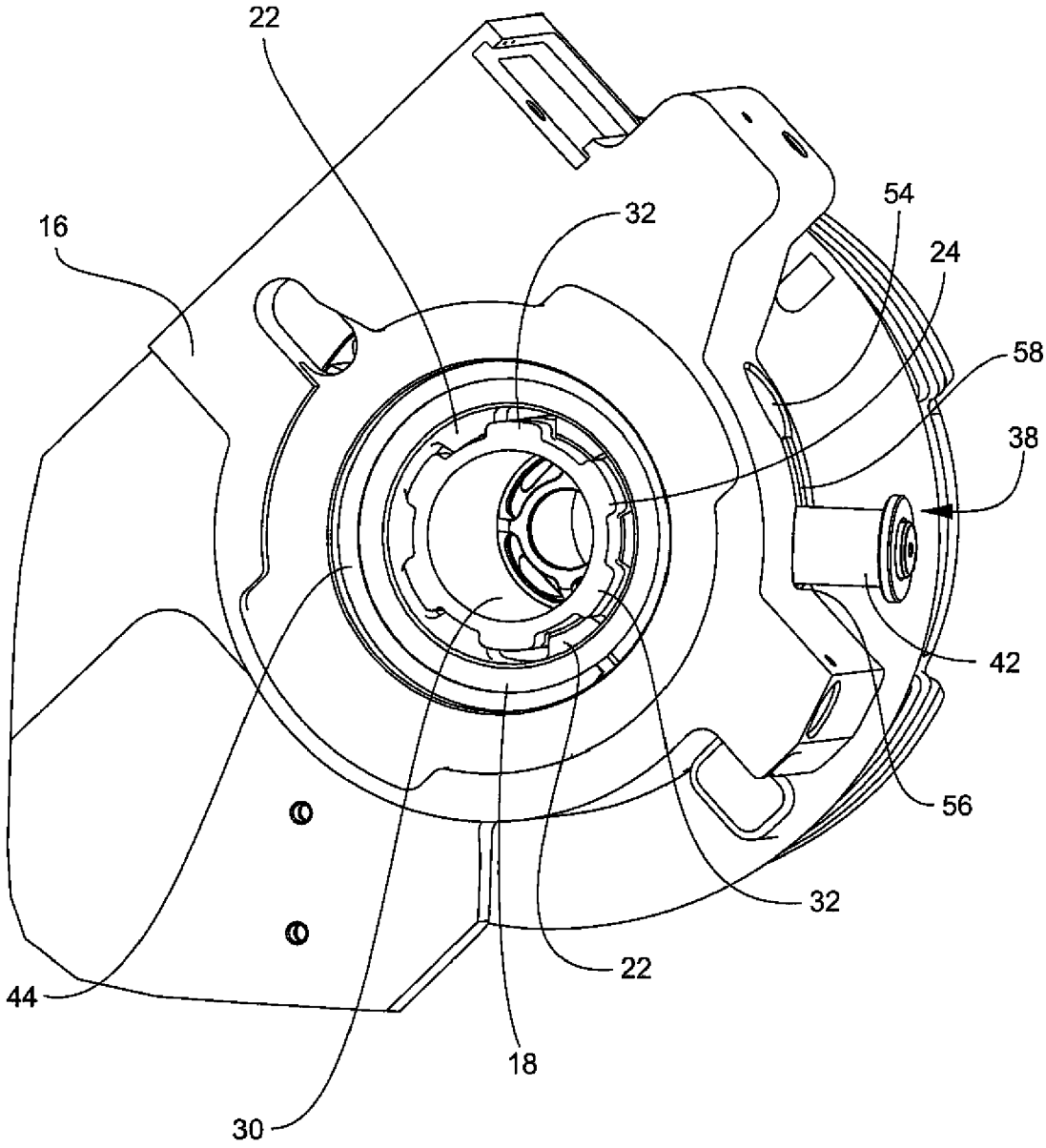
FIG. 3 is a rear perspective view of the quick-release spindle assembly in the spindle release position.
Figure 4:
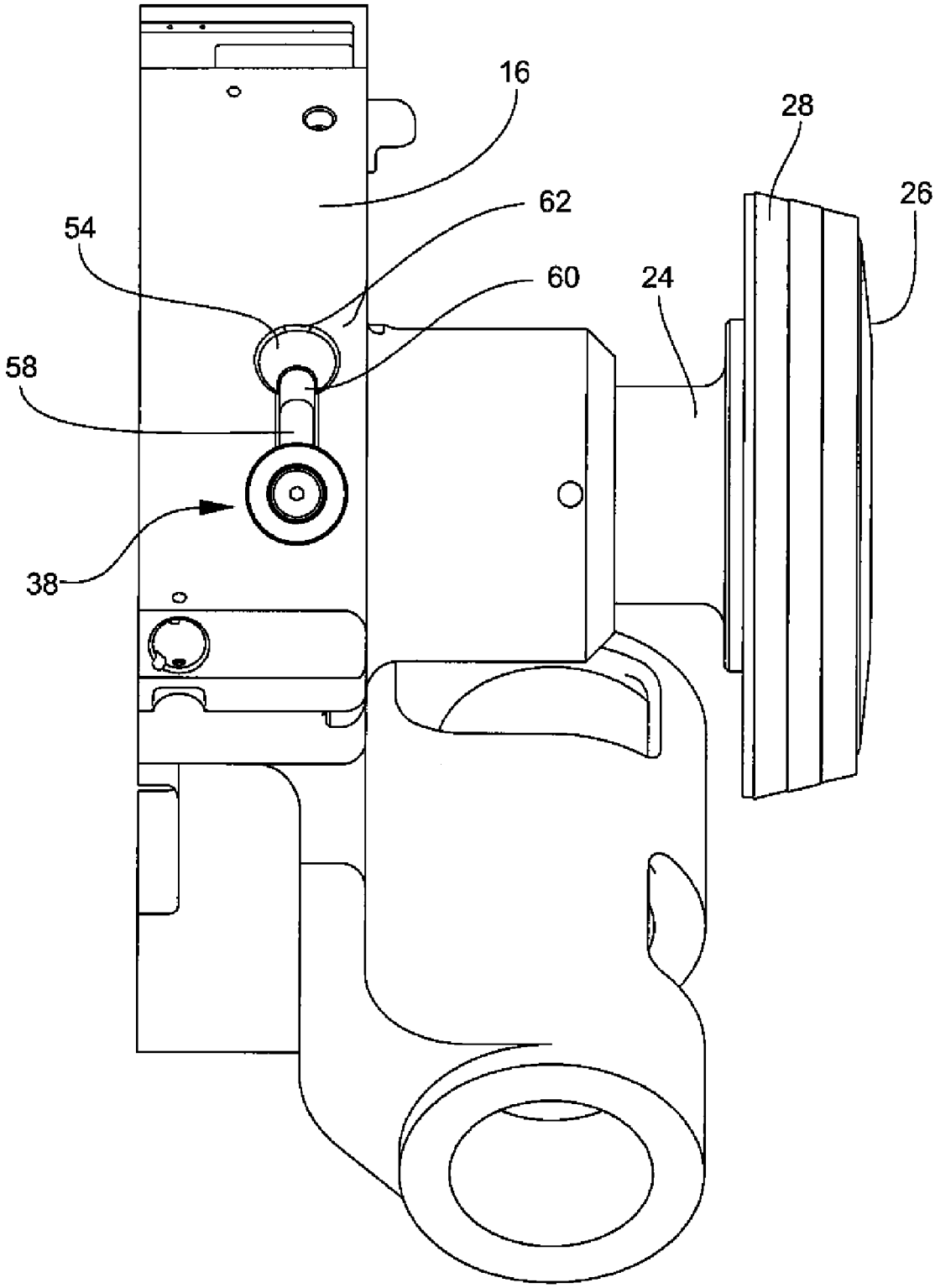
FIG. 4 is a side view of the quick-release spindle assembly in the spindle release position, without the breech block.
Figure 5:
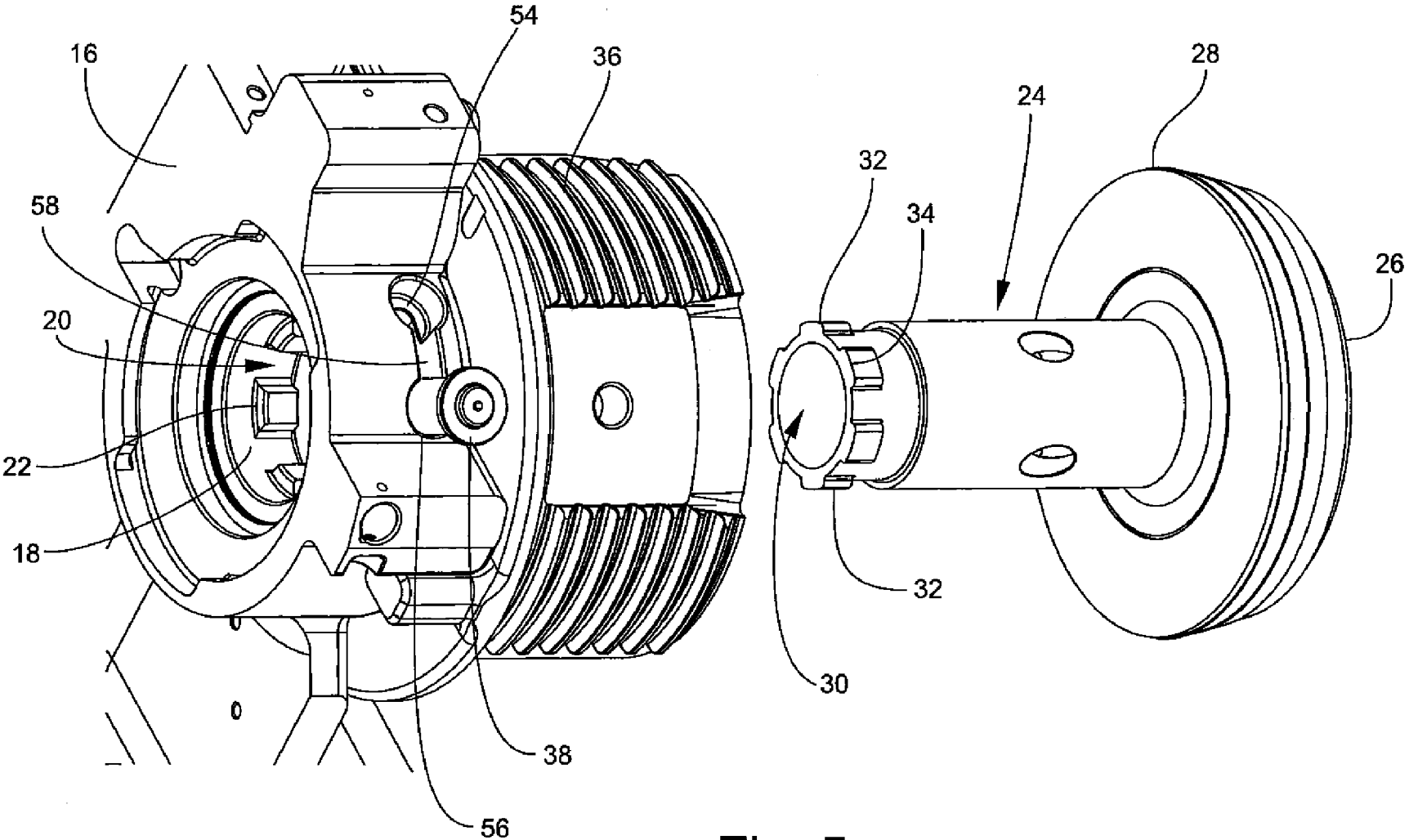
FIG. 5 is a side perspective view of the quick-release spindle assembly in the spindle release position, with the spindle removed from the assembly.

Locking collar 18 may have a through-bore 20. Locking collar 18 may include at least one projection 22 that extends into through-bore 20. A plurality of such projections 22 may be provided. Locking collar 18 may be rotatable between a spindle lock position (FIGS. 7-8) and a spindle release position (FIGS. 3-5).

A spindle 24 may be disposed in through-bore 20 of locking collar 18. Spindle 24 may translate in through-bore 20. Spindle 24 may include an enlarged portion 26 at a forward end thereof. The arrow A in FIG. 2 points in the forward direction. Enlarged portion 26 may engage an obturator pad assembly 28. Spindle 24 may have a central bore 30 (FIG. 3). Spindle 24 may include at least one projection 32 that extends radially outward from a rear outer surface 34 of spindle 24. A plurality of such projections 32 may be provided.

In the spindle lock position (FIGS. 7-8) of locking collar 18, projection(s) 32 of spindle 24 may be aligned with projection(s) 22 of locking collar 18 to thereby prevent translation of spindle 24 in the forward direction. In the spindle release position (FIGS. 3-5) of locking collar 18, projection (s) 32 of spindle 24 may not be aligned with projection(s) 22 of locking collar 18 to thereby allow translation of spindle 24 in the forward direction.

An end of a handle 38 may be fixed to locking collar 18 with, for example, a thread insert 40. Handle 38 may be used to rotate locking collar 18 between spindle lock and spindle release positions. Handle 38 may extend through carrier 16. Handle 38 may include a spring-loaded sleeve 42 for locking handle 38 in spindle lock and spindle release positions. Handle 38 may include a central member 46, such as a bolt, that may be fixed to locking collar 18.

Spring-loaded sleeve 42 may be disposed around central member 46. Spring-loaded sleeve 42 may include a spring 48. One end 50 of spring 48 may bear against one end of sleeve 42 and another end 52 of spring 48 may bear against a top of central member 46.

As seen in FIGS. 3-8, carrier 16 may include a spindle lock hole 54, a spindle release hole 56, and a slot 58 formed between spindle lock hole 54 and spindle release hole 56. Handle 38 may be rotatable between spindle lock hole 54 and spindle release hole 56 by way of slot 58. Spring-loaded sleeve 42 may lock handle 38 in spindle lock hole 54 or spindle release hole 56.

Figure 7:
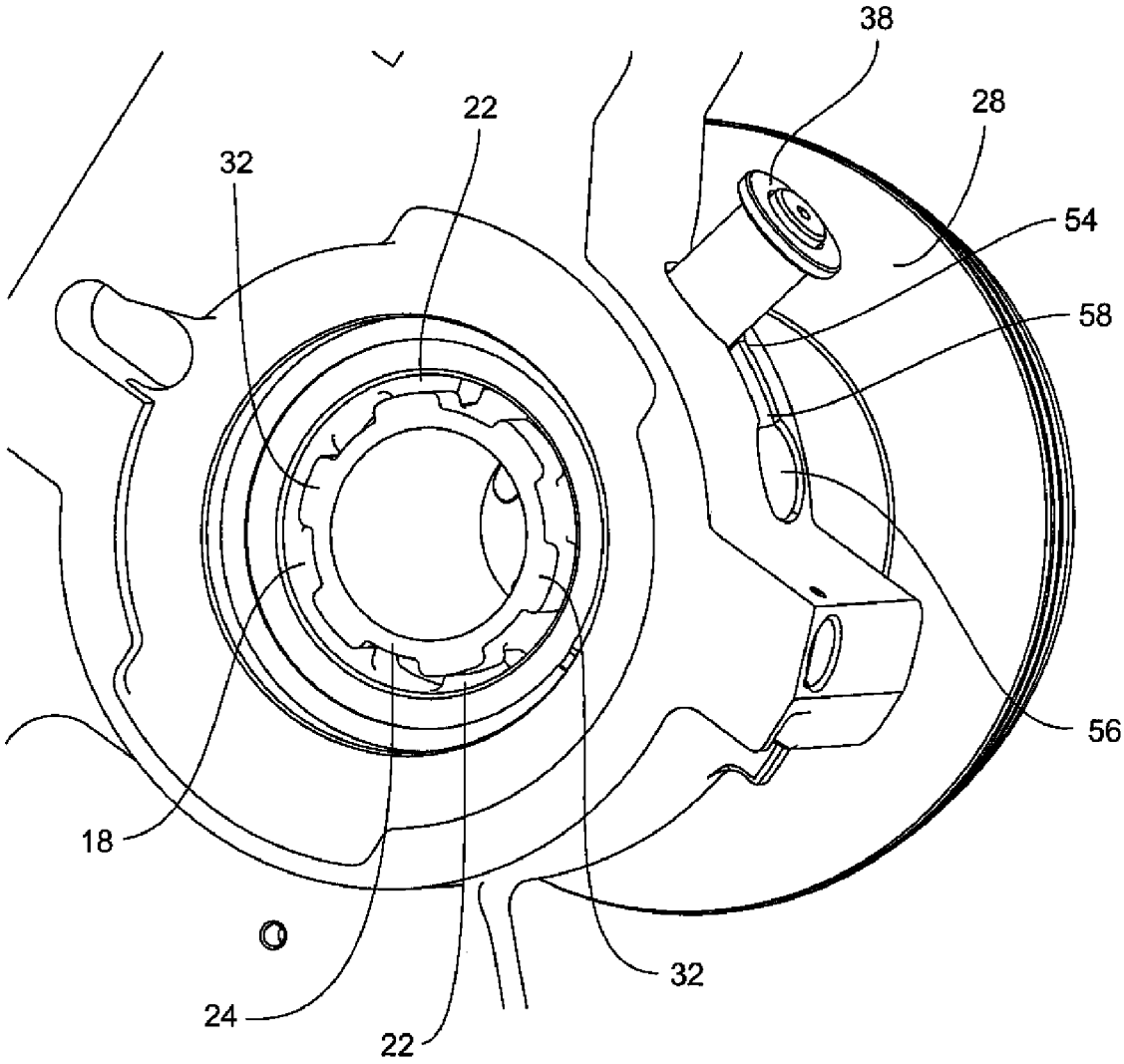
FIG. 7 is a rear perspective view of the quick-release spindle assembly in the spindle lock position.
Figure 8:
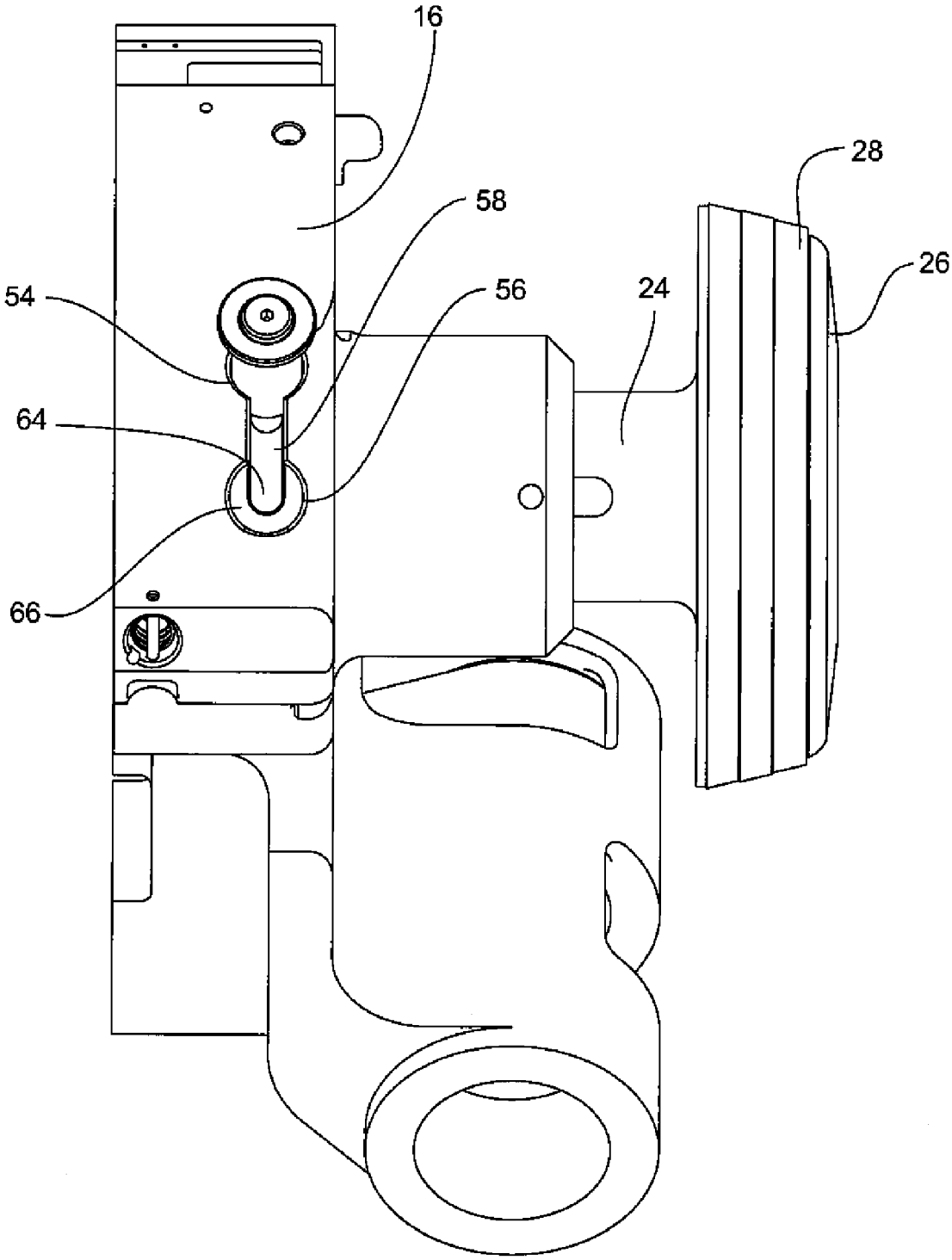
FIG. 8 is a side view of the quick-release spindle assembly in the spindle lock position, without the breech block.

Spindle lock hole 54 and spindle release hole 56 may each include a small diameter bore and a large diameter bore. In FIG. 4, for example, small diameter bore 60 and large diameter bore 62 of spindle lock hole 54 are shown. In FIG. 8, for example, small diameter bore 64 and large diameter bore 66 of spindle release hole 56 are shown. Small diameter bores 60, 64 may be located radially inward of respective large diameter bores 62, 66. Spring-loaded sleeve 42 may be disposed in large diameter bore 62 of spindle lock hole 54 when locking collar 18 is in the spindle lock position (FIGS. 7-8). Spring-loaded sleeve 42 may be disposed in large diameter bore 66 of spindle release hole 56 when locking collar 18 is in the spindle release position (FIGS. 3-5).

To move handle 38 (and locking collar 18) from the spindle release position to the spindle lock position, or vice versa, one may grasp spring-loaded sleeve 42 and move it radially outward out of one of large diameter bore 62 or 66, thereby compressing spring 48. Handle 38 may then be rotated through slot 58 (FIG. 6) to the other of large diameter bore 62 or 66. Releasing spring-loaded sleeve 42 may cause it to move radially inward to the chosen large diameter bore 62 or 66, thereby locking handle 38 and locking collar 18 in place.

FIG. 3 is a rear perspective view of the quick-release spindle assembly in the spindle release position. In FIG. 3, locking collar 18 is locked in the spindle release position. Spring-loaded sleeve 42 of handle 38 is positioned in large diameter bore 66 of spindle release hole 56. Projections 32 of spindle 24 are not aligned with projections 22 of locking collar 18. Therefore, spindle 24 may slide or drop out of the assembly.

FIG. 4 is a side view of the quick-release spindle assembly in the spindle release position, without breech block 36. FIG. 5 is a side perspective view of the quick-release spindle assembly in the spindle release position, with spindle 24 removed from the assembly.

Figure 6:
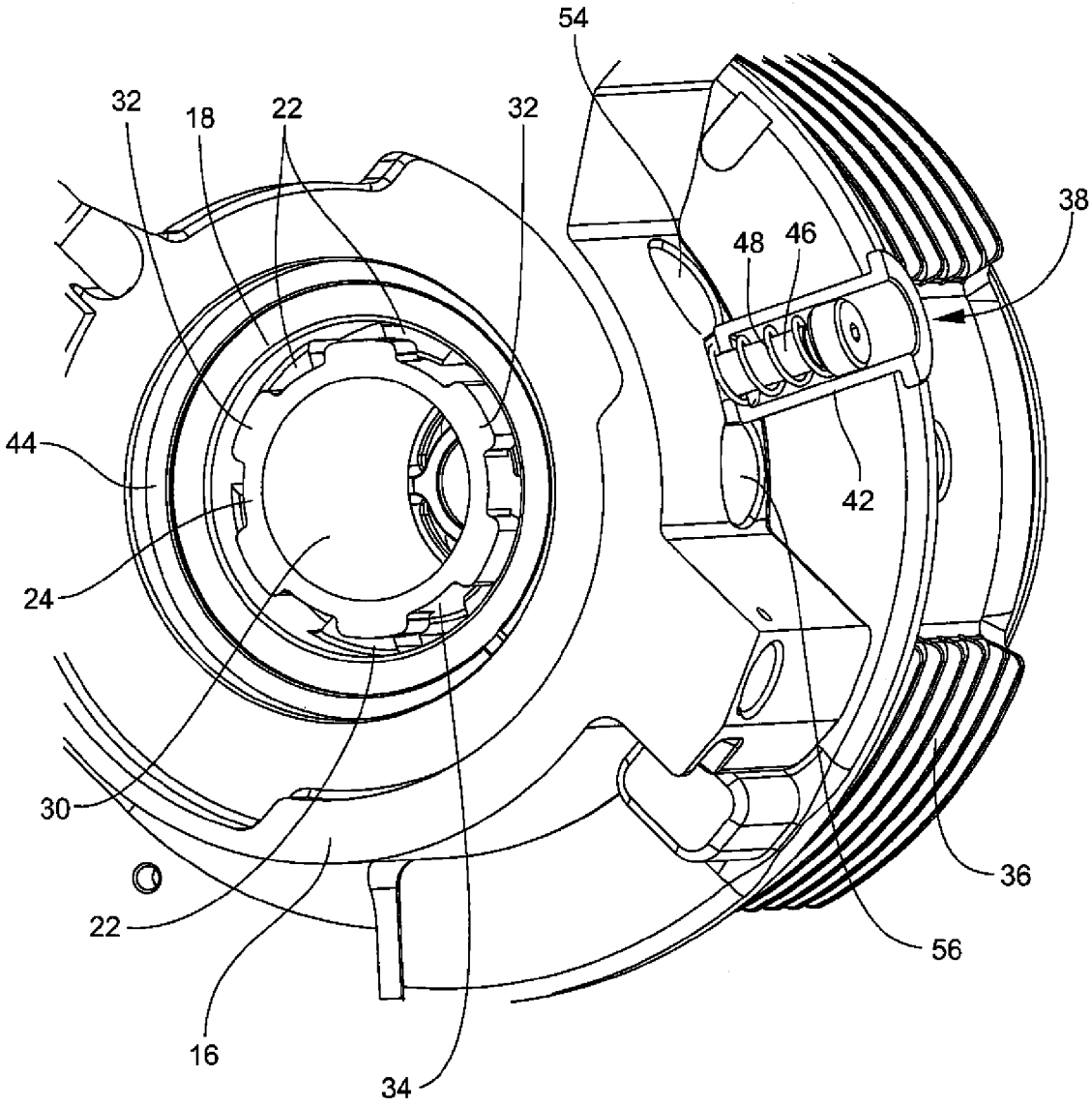
FIG. 6 is a rear perspective view of the quick-release spindle assembly with the spring-loaded locking sleeve in a position intermediate the spindle release and spindle lock positions.

FIG. 6 is a rear perspective view of the quick-release spindle assembly with spring-loaded locking sleeve 42 intermediate the spindle release and spindle lock positions. In this position, central member 46 may be disposed in slot 58 in carrier 16 and sleeve 42 may be located radially outward of slot 58. Thus, handle 38 may be rotated between spindle lock hole 54 and spindle release hole 56, or vice versa.

FIG. 7 is a rear perspective view of the quick-release spindle assembly in the spindle lock position. Spindle 24 is locked in the spindle lock position because spring-loaded sleeve 42 is disposed in large diameter bore 62 of spindle lock hole 54. Projections 32 of spindle 24 are aligned with projections 22 of locking collar 18. FIG. 8 is a side view of the quick-release spindle assembly in the spindle lock position, without breech block 36.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for a breech end of a gun that fires caseless ammunition, the apparatus comprising:

a carrier having a locking collar rotatably disposed therein, the locking collar having a through-bore and at least one projection extending into the through-bore, the locking collar being rotatable between spindle lock and spindle release positions; and a spindle translatably disposed in the through-bore of the locking collar, the spindle including an enlarged portion at a forward end thereof for engaging an obturator pad assembly, a central bore, and at least one projection extending radially outward from a rear outer surface of the spindle;

wherein, in the spindle lock position of the locking collar, the at least one projection of the spindle is aligned with the at least one projection of the locking collar to thereby prevent translation of the spindle in a forward direction, and, in the spindle release position of the locking collar, the at least one projection of the spindle is not aligned with the at least one projection of the locking collar to thereby allow translation of the spindle in the forward direction.

2. The apparatus of claim 1, further comprising a handle fixed to the locking collar for rotating the locking collar between the spindle lock and the spindle release positions, the handle extending through the carrier.

3. The apparatus of claim 2, wherein the carrier includes a spindle lock hole, a spindle release hole, and a slot formed between the spindle lock hole and the spindle release hole, the handle being rotatable between the spindle lock hole and the spindle release hole by way of the slot.

4. The apparatus of claim 3, wherein the handle includes a spring-loaded sleeve for locking the handle in one of the spindle lock hole and the spindle release hole.

5. The apparatus of claim 1, wherein the at least one projection of the locking collar that extends into the through-bore of the locking collar includes a plurality of projections that extend into the through-bore of the locking collar.

6. The apparatus of claim 5, wherein the at least one projection of the spindle that extends radially outward from the rear outer surface of the spindle includes a plurality of projections that extend radially outward from the rear outer surface of the spindle.

7. The apparatus of claim 6, wherein, in the spindle lock position of the locking collar, the plurality of projections of the spindle are aligned with the plurality of projections of the locking collar to thereby prevent translation of the spindle in the forward direction, and, in the spindle release position of the locking collar, the plurality of projections of the spindle are not aligned with the plurality of projections of the locking collar to thereby allow translation of the spindle in the forward direction.

8. The apparatus of claim 4, wherein the handle includes a central member fixed to the locking collar and further wherein the spring-loaded sleeve is disposed around the central member.

9. The apparatus of claim 8, wherein the spindle lock hole and the spindle release hole each include a small diameter bore and a large diameter bore.

10. The apparatus of claim 9, wherein the small diameter bores are located radially inward of the large diameter bores.

11. The apparatus of claim 10, wherein the spring-loaded sleeve includes a spring with one end that bears against one end of the spring-loaded sleeve and another end that bears against a top of the central member.

12. The apparatus of claim 1, further comprising a retaining ring disposed in the carrier to hold the locking collar in the carrier.

* * * * *